United States Patent [19]

Levine et al.

[11] Patent Number: 4,884,719

[45] Date of Patent: Dec. 5, 1989

[54] SINGLE-SAMPLE DISPENSING

[75] Inventors: Sol Levine, Morristown, N.J.; Hernando Sanchez, New York, N.Y.

[73] Assignee: Revlon, Inc., New York, N.Y.

[21] Appl. No.: 947,777

[22] Filed: Dec. 30, 1986

[51] Int. Cl.[4] ..... G07F 11/00

[52] U.S. Cl. ..... 221/25; 221/27; 221/69; 221/70

[58] Field of Search ..... 206/820, 484; 221/25, 221/27, 69, 70, 71; 428/198

[56] References Cited

U.S. PATENT DOCUMENTS

| | | | |
|---|---|---|---|
| 405,412 | 6/1889 | Hicks . | |
| 453,003 | 5/1891 | Hicks . | |
| 1,122,456 | 12/1914 | Woods . | |
| 1,652,402 | 12/1927 | Friedman . | |
| 1,744,532 | 1/1930 | Ean . | |
| 2,061,139 | 11/1936 | Cohen | 206/82 |
| 2,088,076 | 7/1937 | Winslow | 35/59 |
| 2,175,133 | 10/1939 | Singleton | 132/79 |
| 2,234,657 | 3/1941 | Smaldone | 132/73 |
| 2,274,238 | 2/1942 | Henderson et al. | 312/48 |
| 2,343,064 | 2/1944 | Kjorsvik . | |
| 2,378,935 | 6/1945 | Kraft | 132/73 |
| 2,561,400 | 7/1951 | Morrell | 132/79 |
| 2,574,565 | 11/1951 | Hough et al. | 221/71 X |
| 2,758,710 | 8/1956 | Arens | 206/56 |
| 2,998,821 | 9/1961 | Hurdel | 132/88.7 |
| 3,157,912 | 11/1964 | Lisczawka | 18/5.1 |
| 3,258,017 | 6/1966 | Albert . | |
| 3,332,547 | 7/1967 | Rowe et al. . | |
| 3,380,578 | 4/1968 | Sparks | 206/56 |
| 3,386,619 | 6/1968 | Douglas | 221/135 |
| 3,467,250 | 7/1969 | D'elia et al. . | |
| 3,482,733 | 12/1969 | Groves | 221/25 |
| 3,485,349 | 12/1969 | Chaney . | |
| 3,494,505 | 2/1970 | Huebner et al. . | |
| 3,583,558 | 6/1971 | Davis . | |
| 3,598,685 | 8/1971 | Lee et al. . | |
| 3,674,176 | 7/1972 | Sagi | 221/135 |
| 3,698,600 | 10/1972 | Foote . | |
| 3,709,403 | 1/1973 | Harriman . | |
| 3,788,917 | 1/1974 | Linda | 156/82 |
| 3,811,987 | 5/1974 | Wilkinson et al. | 156/497 |
| 3,835,992 | 9/1974 | Adams, IV . | |
| 3,858,722 | 1/1975 | Haas | 206/380 |
| 3,861,560 | 1/1975 | Entwistle et al. . | |
| 3,885,724 | 5/1975 | Ehrlund . | |
| 3,964,638 | 6/1976 | Dimauro | 221/3 |
| 3,984,030 | 10/1976 | Morini . | |
| 4,032,004 | 6/1977 | Coates . | |
| 4,111,333 | 9/1978 | Norgaard . | |
| 4,121,004 | 10/1978 | Ehrlund . | |
| 4,150,741 | 4/1979 | Rubin . | |
| 4,180,181 | 12/1979 | Brandwein . | |
| 4,224,092 | 9/1980 | Thompson et al. | 156/82 |
| 4,274,550 | 6/1981 | Feldstein . | |
| 4,294,357 | 10/1981 | Stevens et al. . | |
| 4,387,831 | 6/1983 | McNally | 221/70 X |
| 4,437,579 | 3/1984 | Obland . | |
| 4,457,427 | 7/1984 | Cafiero | 206/484 X |
| 4,550,857 | 11/1985 | Castner, Sr. et al. . | |
| 4,576,311 | 3/1986 | Horton et al. . | |
| 4,611,611 | 9/1986 | Beal, Jr. . | |
| 4,637,523 | 1/1987 | Levasseur . | |
| 4,653,664 | 3/1987 | Hineno et al. . | |
| 4,751,934 | 6/1988 | Moir | 132/79 D |

FOREIGN PATENT DOCUMENTS

| | | |
|---|---|---|
| 598710 | 5/1960 | Canada . |
| 1218492 | 6/1966 | Fed. Rep. of Germany . |
| 1511865 | 9/1969 | Fed. Rep. of Germany . |

*Primary Examiner*—Joseph J. Rolla
*Assistant Examiner*—Mona Beegle

[57] ABSTRACT

A plurality of samples of a cosmetic product, such as nail enamel, lipstick, powder or cream makeup, fragrance, and the like, each comprising a quantity suitable for one sample dose, are provided on a sheet or continuous strip of material. The strip is provided with perforations between adjacent dose units to permit a prospective customer to tear off one or several samples at a time from the strip. The sheet or strip can be provided on a reel for convenient and compact disposition at the point of purchase.

31 Claims, 1 Drawing Sheet

SINGLE-SAMPLE DISPENSING

BACKGROUND OF THE INVENTION

The present invention relates generally to the marketing of products such as cosmetics, fragrances and toiletries and more particularly to providing small, hygienic discrete disposable samples of a cosmetic product at the point of purchase so that a prospective customer can sample the product in deciding whether to purchase it. The property that the prospective purchaser wishes to evaluate will of course vary depending on the type of product involved, be it cream, nail enamel, powder, fragrance, and so forth.

Present known sampling techniques have numerous disadvantages. For instance, when a container of the product containing a larger quantity then that needed for just one sample is left out on a store counter, it becomes unsightly and possibly unhygienic as successive customers help themselves to samples of the product. Also, over time the product in the container may not necessarily reflect the true characteristics of the product in question. When the product is a nail enamel, in which the shade of color is perhaps the most important characteristic, attempts to reproduce the color on "chips" which are in reality pieces of colored plastic, do not necessarily permit perfect reproduction of the color.

In addition, the sheer number of variations of shade, scent, and other product characteristics now available in today's cosmetic marketplace leads to a proliferation of testers or samplers which can result in an unsightly jumble of containers, or in a display which occupies valuable counter space.

Thus, there is a need for a reliable, economic, esthetic means for providing individual sample doses of cosmetic products at the point of purchase for evaluation by a prospective customer.

SUMMARY OF THE INVENTION

In summary, the present invention comprises a device for providing discrete disposable individual or multiple sample doses of a cosmetic, toiletry or fragrance product. One embodiment comprises an elongated flat strip the width of a single dose unit and intermittently perforated to provide selectively detachable dose units, wherein each dose contains a quantity of cosmetic product comprising a single sample thereof. In preferred embodiments, the elongated strip can be wound onto a spool and a plurality of such spools can be disposed on a common axis side by side at the point of purchase to provide the customer with a variety of samples from which to choose.

Another embodiment is a sheet containing a plurality of single sample doses of a product. The sheet can, if desired, be perforated to permit sample doses to be detached from the sheet.

DETAILED DESCRIPTION OF THE INVENTION

The present invention is useful in allowing customers to sample cosmetic products which they are considering buying, while avoiding waste of the product. As used herein, the term "cosmetic product" is intended to cover makeup, fragrance, and toiletry products.

Figure 1:
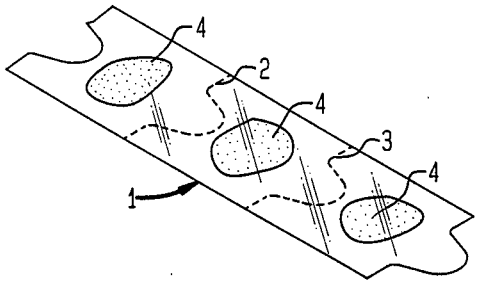
FIG. 1 is a perspective view of one strip comprising the device of the present invention.

Referring to FIG. 1, the present invention includes support strip 1 which is preferably made of thin gauge cardboard, paper or plastic material such as PVC sheet, polyethylene sheet, and the like.

The support strip 1 should be sufficiently stiff so that it does not fold over on itself of its own weight, but should be capable of moderate flexibility so that it can be rolled onto a reel. The strip 1 is typically half an inch to two inches wide. The strip can be opaque, in which case it is preferably black or another color which will not interfere with evaluation of the color of a sample of cosmetic product placed thereon. In one preferred embodiment it will be advantageous to make the support strip transparent. In another preferred embodiment the support strip has a light colored area on which the product is deposited, and black areas adjacent thereto to provide color contrast.

Strip 1 does not have to be perforated, since individual samples can simply be cut off the strip with scissors. Preferably, for easier detachment, strip 1 is intermittently perforated as shown in FIG. 1 at reference numerals 2 and 3. The perforations can be in a straight line, or can trace a curved path as they progress from one edge to the other of strip 1. The perforations should permit the strip to remain integral during handling, but should permit dose units to be selectively detached from the strip by moderate manual force applied in a direction parallel to the length of the strip. Means are well known in the plastic art for providing perforations having these characteristics. Strip 1 can comprise any desired number, from 10 to 20 up to 500 to 1,000, or more single dose units separated by the indicated perforations.

Strip 1 additionally comprises single sample quantities 4 of the cosmetic product disposed on each dose unit defined by successive perforations 2 on strip 1. The form in which the cosmetic product is deposited on the strip 1 for sampling depends to some extent on the physical properties of the product, and on the property that is to be sampled, but otherwise the product sample can take any form desired by the marketer.

When the product is a nail enamel, eyeliner, mascara, or equivalent product capable of drying to a thin film, the sample of cosmetic product on strip 1 can comprise simply a small quantity thereof spread onto the center of each dose unit to form a film thereof. When the product comprises a perfume, cologne, or equivalent product in which the primary attribute is the scent, the product can be microencapsulated in a known manner and the microcapsules deposited in known fashion onto each dose unit of the strip 1. This would permit the customer to sample the product needed by merely sniffing it, or by lightly scratching the microcapsules to cause them to break and thereby release additional scent.

When the product is a powdery material, a thin film of it can be deposited onto each dose unit as is the case for the nail enamel and equivalent products. If desired a sufficient amount of the powdery material can be deposited to permit the customer to rub some of it onto her hand or face from the dose unit.

Figure 2:
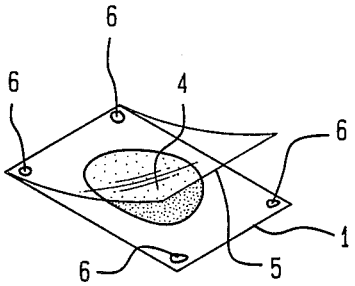
FIG. 2 is a perspective view of another embodiment of the present invention.

In a preferred embodiment, the strip device of the present invention further comprises an opaque, colored, patterned or transparent top strip 5 whose width and length are identical to that of the strip 1. This embodiment is shown in FIG. 2. The support strip 1, and cosmetic sample 4, are as shown in FIG. 1. Top strip 5 is cut, or provided with perforations, at the same location as the perforations in strip 1. The top strip 5 should be releasably attached to the support strip 1 between each successive set of perforations 2. In that way, when a single dose unit is detached from the strip the top strip will remain attached to the support strip on that dose unit. Preferably, the top strip is attached to the support strip 1 by pressure adhesive at two, three or four points, as shown as 6 in FIG. 2, or along one edge, thereby allowing the customer to lift the top strip to sample the tactile properties of the cosmetic product. The top strip, especially if it is transparent, permits the customer to sample the cosmetic product visually. The top strip also advantageously prevents the product from being rubbed or transferred onto the bottom of the support strip 1 when the strip is rolled onto a reel.

In another embodiment, the top sheet is sealed to the support sheet on three edges, leaving a fourth edge unsealed so that the customer can insert a finger tip into the resulting small envelope and can neatly withdraw small quantities as desired of the product.

When the product being sampled in the present invention is in a liquid or pasty semi-liquid form, the top strip is preferably sealed completely to the support strip around the edges thereof to form a small packet or envelope of the product being sampled. Care should be taken in forming the packets and the seams which are adjacent the perforation such that the act of grasping the exposed lower edge of one packet and forceably detaching it from the strip along its perforations will not inadvertently cause the packet to rupture. This embodiment of the present invention is particularly useful for a product such as creams, lotions, and products having equivalent characteristics. Satisfactory single-sample quantities of such products are 0.25 to 1 fluid ounce.

Figure 3:
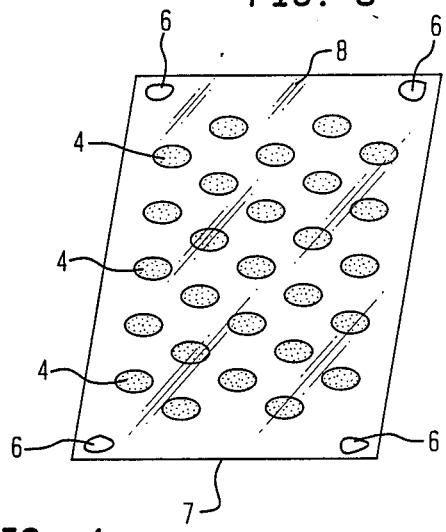
FIG. 3 is a perspective view of an embodiment of this invention comprising a flat sheet containing several samples.

In another alternative, shown in FIG. 3, the present invention comprises a support sheet 7 which can have the same characteristics of stiffness, flexibility and visual appearance as discussed above for support strip 1. A plurality of single dose quantities 4 of cosmetic product are carried on support sheet 7, and a top sheet 8 is superimposed over the support sheet. Top sheet 8 is preferably transparent, and is attached releasably to support sheet 7 by spots 6 of adhesive. If desired, the support sheet 7 and top sheet 8 can be perforated so that individual dose units can be detached from the sheet. In this embodiment, the top sheet should be releasably adhered (or sealed) to the support sheet in each dose units that the top sheet stays attached after the dose unit is detached.

Sampling devices in accordance with the present invention can readily be manufactured by known processes. For instance, a sheet of plastic material can be slit to the desired width, perforated in accordance with known techniques, and the cosmetic product deposited in single dose quantities onto each dose unit between successive perforations. In the embodiments including a top strip, that sheet can likewise be cut to size, perforated as desired, and attached to each dose unit after the sample of cosmetic material is deposited thereon. The top strip can be attached with spots of glue or a narrow strip of glue, or by appropriate heat using a heated mandrel of the type conventionally used to fuse plastic sheets together. Likewise, dose units comprising sealed packets of liquid or semi-liquid material can be formed using conventional technology employed in the art of sealing plastic packets.

Alternatively, the top strip can be removably attached to the support strip by a thin layer of an appropriate adhesive permitting removal of the top strip. This adhesive can be placed adjacent one, two, three, or all four edges of the dose unit. In this embodiment, the user detaches a dose unit from strip 1 and then peels off the top strip to reveal the sample of cosmetic product.

The top strip can be made of thin plastic film or sheet, or can be paper when the top strip is not required to contain a quantity of liquid product. However, when the entire dose unit comprises a sealed packet of material, it can be made entirely of paper glued together to provide the required sealing to retain the liquid contents until such time as they are released by the customer.

Figure 4:
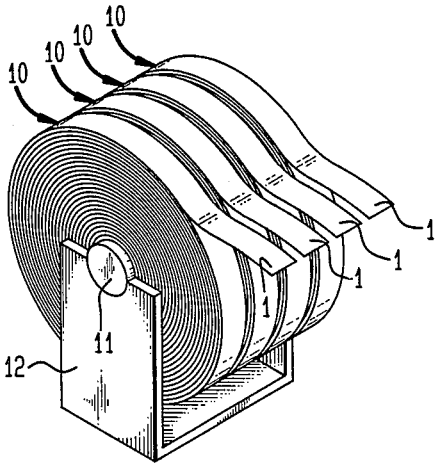
FIG. 4 is a perspective view of a plurality of spools embodying the device of the present invention.

As shown in FIG. 4, a strip of samples prepared in accordance with this invention can be wound onto a spool 10, and several spools can be placed side by side on a common axle 11 in a holder 12. The holder 12 can be placed on the countertop in a store, where prospective customers can detach dose units to sample the product.

The invention can also comprise the strips mentioned above on which a series of different products are placed in sequence on the strip. In this way, a customer can examine and compare numerous different shades, scents, and/or textures all at once. Strips with such a series of different products can also be used on point-of-purchase displays to show the range of product varieties that are available. In addition, individual sample doses can be inserted into cartons containing the actual product, so that they are visible through small windows in the cartons. This lets the customer see the actual shade of the product being purchased, without having to open the carton.

What is claimed is:

1. A cosmetic sampler adapted for the manual dispensing of cosmetic product samples at a point-of-purchase location, comprising supporting means for supporting a plurality of cosmetic product samples, said supporting means including first dividing means for dividing said supporting means into a plurality of individual dose units in such a manner that each of said dose units is connected to but separable from at least one adjoining dose unit, each of said dose units containing a cosmetic product sample; covering means for covering said cosmetic product samples contained on said supporting means, said covering means including second dividing means for dividing said covering means into a plurality of protective top pieces in such a manner that each of said top pieces is connected to but separable from at least one adjoining top piece, each of said top pieces being arranged in overlying registry with a corresponding one of said dose units so as to protect said cosmetic product sample contained thereon; and attaching means for attaching said covering means to said supporting means in such a manner that each of said top pieces is removably attached to its corresponding dose unit at a plurality of spaced-apart locations, the spacing between said locations being selected so as to provide a top piece which has been separated from its said at least one adjoining top piece with a plurality of substantially free tab sections, each of said tab sections being located at a peripheral region of said top piece and being readily accessible for gripping by a user, whereby said top piece may, after its corresponding dose unit has been separated from its said at least one adjoining dose unit, be gripped by a user at a randomly chosen one of said tab sections and then removed to expose said cosmetic product sample protected thereby.

2. A cosmetic sampler according to claim 1, wherein said covering means is transparent.

3. A cosmetic sampler according to claim 1, wherein said cosmetic product samples are thin films of a cosmetic product deposited onto said supporting means.

4. A cosmetic sampler according to claim 1, wherein said cosmetic product samples are microcapsules of a cosmetic product applied to said supporting means.

5. A cosmetic sampler according to claim 1, wherein said cosmetic product samples are removably applied to said supporting means.

6. A cosmetic sampler according to claim 1, wherein at least some of said cosmetic product samples are a first cosmetic product and at least some of said cosmetic product samples are a second cosmetic product.

7. A cosmetic sampler according to claim 1, wherein said covering means is adhesively attached to said supporting means at each of said spaced-apart locations and at each of said spaced-apart locations only.

8. A cosmetic sampler according to claim 1, wherein said covering means is fused to said supporting means at each of said spaced-apart locations and at each of said spaced-apart locations only.

9. A cosmetic sampler according to claim 1, wherein all of said dose units are substantially identical to each other.

10. A cosmetic sampler according to claim 1, wherein said supporting means includes an elongated support strip having a width and a length, and wherein said cosmetic product samples are arranged seriatim and at spaced intervals along the length of said support strip.

11. A cosmetic sampler according to claim 10, wherein said first dividing means includes a plurality of rows of perforations extending widthwise relative to said support strip at fixed intervals along the length thereof, and wherein each of said cosmetic product samples is separated from an adjacent cosmetic product sample by one of said rows of perforations.

12. A cosmetic sampler according to claim 11, wherein said covering means includes an elongated cover strip having a width and a length substantially the same as the width and the length, respectively, of said support strip.

13. A cosmetic sampler according to claim 12, wherein said cover strip is transparent.

14. A cosmetic sampler according to claim 12, wherein said support strip and said cover strip are wound about a spool, whereby said dose units can be accessed by unwinding said cosmetic sampler.

15. A cosmetic sampler according to claim 12, wherein said second dividing means includes a plurality of rows of perforations extending widthwise relative to said cover strip at fixed intervals along the length thereof, each row of perforations in said cover strip being in overlying registry with a corresponding one of said rows of perforations in said support strip.

16. A cosmetic sampler according to claim 15, wherein each of said rows of perforations in said support strip extends across the width thereof along a straight path, and wherein each of said rows of perforations in said cover strip extends across the width thereof along a straight path.

17. A cosmetic sampler according to claim 15, wherein each of said rows of perforations in said support strip extends across the width thereof along a curved path, and wherein each of said rows of perforations in said cover strip extends across the width thereof along a curved path.

18. A cosmetic sampler according to claim 15, wherein said support strip and said cover strip are transparent.

19. A cosmetic sampler according to claim 1, wherein said supporting means includes a flat support sheet, and wherein said cosmetic product samples are arranged seriatim and at spaced intervals along at least two different dimensions of said support sheet.

20. A cosmetic sampler according to claim 19, wherein said covering means is a flat cover sheet having a size which matches that of said support sheet and a shape which matches that of said support sheet.

21. A cosmetic sampler according to claim 20, wherein said support sheet and said cover sheet are transparent.

22. A cosmetic sampler according to claim 20, wherein said cover sheet is transparent.

23. A cosmetic sampler according to claim 20, wherein said support sheet has a width and a length, and wherein said cosmetic product samples are arranged seriatim and at spaced intervals along the width and the length of said support sheet, whereby said dose units are arranged in a plurality of side-by-side rows extending widthwise relative to said support sheet and in a plurality of side-by-side rows extending lengthwise relative to said support sheet.

24. A cosmetic sampler according to claim 23, wherein said first dividing means includes a plurality of rows of perforations extending widthwise relative to said support sheet at fixed intervals along the length thereof and a plurality of rows of perforations extending lengthwise relative to said support sheet at fixed intervals along the width thereof.

25. A cosmetic sampler according to claim 24, wherein each of said cosmetic product samples is separated from an adjacent cosmetic product sample by at least one of said widthwise-extending rows of perforations in said support sheet and by at least one of said lengthwise-extending rows of perforations in said support sheet.

26. A cosmetic sampler according to claim 25, wherein said cover sheet has a width and a length substantially the same as the width and the length, respectively, of said support sheet.

27. A cosmetic sampler according to claim 26, wherein said second dividing means includes a plurality of rows of perforations extending widthwise relative to said cover sheet at fixed intervals along the length thereof, each of said widthwise-extending rows of perforations in said cover sheet being in overlying registry with a corresponding one of said widthwise-extending rows of perforations in said support sheet, and a plurality of rows of perforations extending lengthwise relative to said cover sheet at fixed intervals along the width thereof, each of said lengthwise-extending rows of perforations in said cover sheet being in overlying registry with a corresponding one of said lengthwise-extending rows of perforations in said support sheet.

28. A cosmetic sampler according to claim 27, wherein each of said lengthwise-extending rows of perforations in said support sheet and each of said lengthwise-extending rows of perforations in said cover sheet extend along a straight path, and wherein each of said widthwise-extending rows of perforations in said support sheet and each of said widthwise-extending rows of perforations in said cover sheet extend along a straight path.

29. A cosmetic sampler according to claim 27, wherein each of said lengthwise-extending rows of perforations in said support sheet and each of said lengthwise-extending rows of perforations in said cover sheet extend along a straight path, and wherein each of said widthwise-extending rows of perforations in said support sheet and each of said widthwise-extending rows of perforations in said cover sheet extend along a curved path.

30. A cosmetic sampler according to claim 27, wherein the width and the length of said support sheet are substantially the same, whereby said support sheet has a substantially square shape, and wherein the width and the length of said cover sheet are substantially the same, whereby said cover sheet has a substantially square shape.

31. A cosmetic sampler according to claim 27, wherein the width and the length of said support sheet are not substantially the same, whereby said support sheet has a substantially rectangular shape, and wherein the width and the length of said cover sheet are not substantially the same, whereby said cover sheet has a substantially rectangular shape.

* * * * *